United States Patent [19]

Morehouse

[11] Patent Number: 4,500,137

[45] Date of Patent: Feb. 19, 1985

[54] PHYSIOLOGICAL CHAIR

[76] Inventor: Laurence E. Morehouse, 209 16th St., Manhattan Beach, Calif. 90266

[21] Appl. No.: 341,542

[22] Filed: Jan. 21, 1982

[51] Int. Cl.[3] ..... A47C 7/02; A47C 7/46

[52] U.S. Cl. ..... 297/458; 297/418; 297/445; 297/460; D6/364

[58] Field of Search ..... 297/458, 459, 460, 284, 297/445, 418; D6/26, 31

[56] References Cited

U.S. PATENT DOCUMENTS

| | | | |
|---|---|---|---|
| D. 193,889 | 9/1962 | Buzzitta | D6/31 |
| 2,208,745 | 7/1940 | Bloomberg | 297/459 |
| 3,482,874 | 12/1969 | Henebry et al. | 297/458 X |
| 4,153,294 | 5/1979 | Meiller et al. | 297/458 X |

FOREIGN PATENT DOCUMENTS

| | | | |
|---|---|---|---|
| 1962722 | 6/1971 | Fed. Rep. of Germany | 297/284 |
| 1380914 | 10/1964 | France | 297/459 |
| 713927 | 9/1966 | Italy | 297/445 |

*Primary Examiner*—James T. McCall
*Assistant Examiner*—Peter R. Brown
*Attorney, Agent, or Firm*—Ralph B. Pastoriza

[57] ABSTRACT

The chair has a specially constructed seat made up of a forward section, central section and rear section functioning respectively as thigh, tuber and sacral supports for an occupant seated in the chair. The central section serving as the tuber support is inclined upwardly in a rearward direction at a slight angle. The rear section or sacral support, in turn, is increasingly inclined at a greater angle to terminate in an arcuate rear edge for the seat so that the left and right sides of this rear section wrap around the sides of the central section to provide a crescent-shaped cup rim functioning to support the sacrum even when the occupant sits obliquely in the chair. Back and arm rests are provided and cooperate together to define a hip rest bulge which extends horizontally over 180° so that again proper pelvic support is provided for an occupant sitting obliquely in the chair. The components are so formed that the chair better enables the sitter to freely shift from one sitting posture to most any other sitting posture, all the while providing comfortable support. In essence, the construction motivates the sitter to move about, changing from posture to posture so that the sitter remains more alert and productive than would otherwise be possible.

9 Claims, 6 Drawing Figures

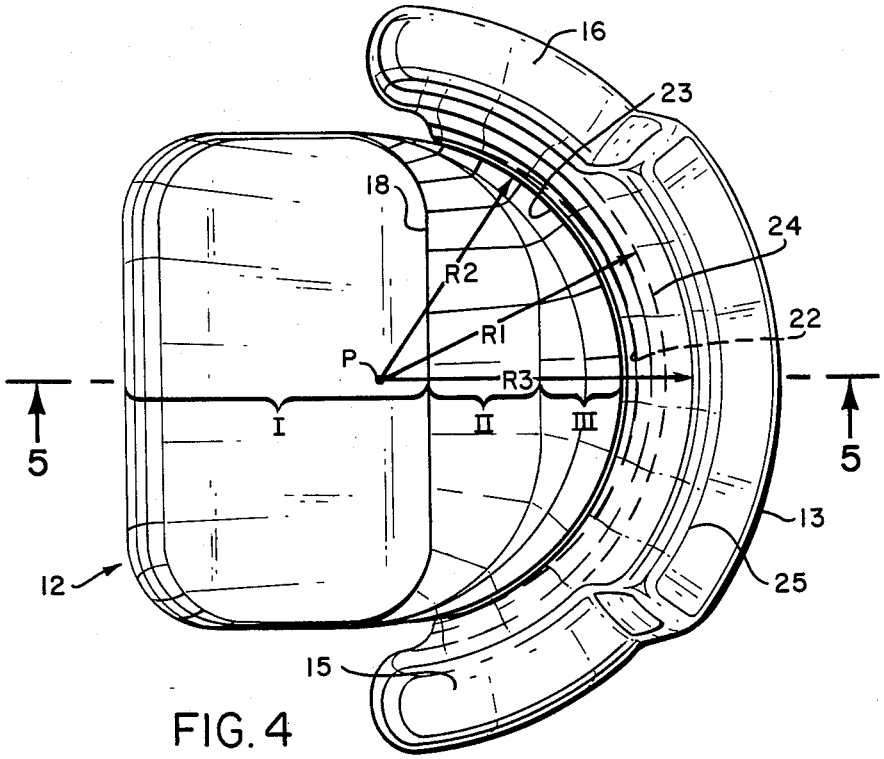
FIG. 4
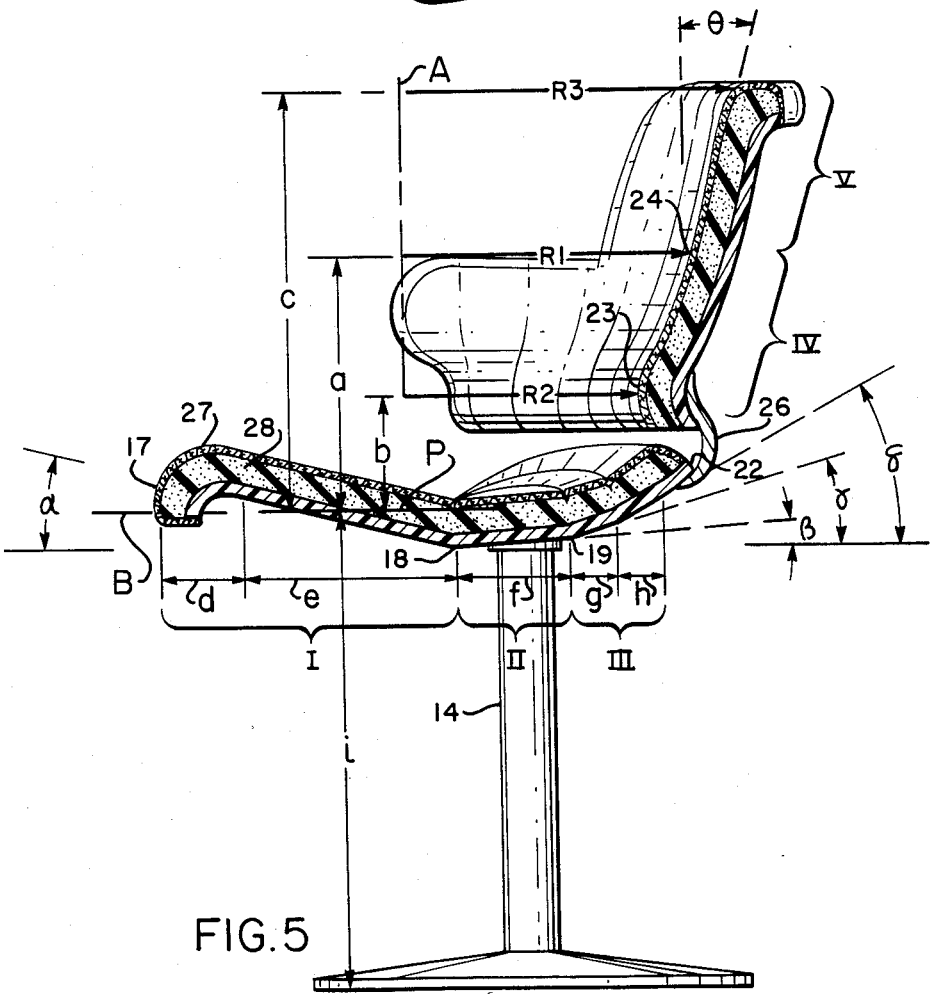
FIG. 5
| TABLE: |
|---|
| R1 = 10" |
| R2 = 8½" |
| R3 = 11" |
| a = 9" |
| b = 4" |
| c = 15" |
| d = 3" |
| e = 7½" |
| f = 4" |
| g = 1½" |
| h = 1½" |
| i = 17½" |
| α = 13° |
| β = 5° |
| γ = 13° |
| δ = 35° |
| θ = 15° |
FIG. 6

PHYSIOLOGICAL CHAIR

FIELD OF THE INVENTION

This invention relates to chairs capable of accommodating most all kinds of sitting postures so as to be readily applied to different uses such as executive, operational, spectator or institutional seating. The chairs can thus be used at desks, tables, counters and consoles as well as in waiting rooms at railroad stations, airports and the like.

BACKGROUND OF THE INVENTION

Normally, chairs have been designed for style to decorate rooms according to period of fashion, mostly without regard for healthful comfort or functional behavior. A few "orthopedic" chairs have been designed with appropriate bracing features in the hopes of correcting malformed postures or curing backaches, but no chair can really do these things. Furthermore, when a sitter is forced by a chair's design into one "proper" posture, typically sitting up straight with both feet flat on the floor and prevented from assuming alternate or "unusual" postures, the resulting deprivation of motion inevitably leads to discomfort and pain.

With the foregoing rather narrow precept in mind, previous ergonomists have employed ratings of rising discomfort and have timed the onset of pain in subjects sitting up straight with fboth feet flat on the floor as discriminating criteria in evaluating features and dimensions of chairs. As a further criteria, these ergonomists have downgraded the value of a chair if subjects moved away from the "experimental" position and selected chairs in which subjects scored the least movements per unit timed. These investigators considered the number and intensity of movements, or "fidgeting", to be negative criteria because movement was seen to interfere with a primary activity such as reading (although reading scores were not registered), and movement was judged to be a response to pain.

To this day, no one has constructed a chair that does not discourage normal fidgeting and squirming and does not interfere with the myriad of postures and body-chair linkages the long term sitter involuntarily seeks to assume to escape the discomfort of sitting.

Some chairs have in the past been designed to relieve the discomfort and pain of one-position seating. For example, a vibrator has been attached to a chair to restore circulation. Other chairs use hinges and springs to allow the sitter to lean backward and then forward. Although these articulating chairs allow changes in the degree of hip flexion and some movement in the anterio-posterior plane, they are otherwise designed for one-position seating; twisting and turning movements are obstructed by these chairs. Rocking chairs provide for some movement in the knees and ankles only, but discourage gross posture changes or wide movements due to instability.

As a kinesiologist, and from my studies of the physiology of exercise, I know that most all postures are "proper" and "natural" and that movement from posture to posture (as one does in all forms of physical activity) is absolutely necessary for good body function, particularly for blood circulation, for well being, as motion releases excess tension and for well-doing as the kinesthetic stimulation of movement preserves alertness. Following this essential principle of salubrious movement, it is clear that any chair that traps the body into one position, as do "contoured" chairs with their seats dished or saddle-shaped, is unsound.

BRIEF DESCRIPTION OF THE PRESENT INVENTION

With the foregoing in mind, I have constructed a chair which will motivate motion of the occupant of sufficient extent and variety to produce many unique benefits. In its broadest aspect, this chair includes a seat having a central section which is inclined upwardly in a rearward direction to function as a tuber support for an occupant. This central section merges into an increasingly inclined rear section terminating in an arcuate rear edge for the seat so that the left and right sides of the rear section wrap around the sides of the central section to provide a crescent-shaped cup rim functioning as a sacral support for an occupant, even when the occupant sits obliquely in the chair.

In a preferred embodiment, the crescent shaped cup extends over 180° from the left to right side of the chair and there is provided a forward section sloping downwardly from adjacent to its front edge to its interception with the central section. This forward section is flat from side to side and functions as a thigh support.

The preferred embodiment is completed by the provision of a back and arm rests which cooperate to provide a hip rest in the form of a bulge sweeping out an arc of 180° when viewed in plan, these components all cooperating together so that changes in posture of an occupant are motivated during prolonged seating, proper support and stability being provided for a variety of different postures so that the occupant remains more alert and productive than would otherwise be possible.

The foregoing arrangement of compound curves providing the integrated seat, hip rest, back rest and arm rest assembly derive from kinesiological analysis of the human anatomy and eliminates the need for rockers, swivels, springs, hydraulic valves, vibrators or other moving parts. Since the unique construction of my invention accommodates most all kinds of sitting postures, it is readily applied in any application which involves prolonged periods of seating, such as for executives or in waiting rooms and the like as briefly mentioned heretofore.

BRIEF DESCRIPTION OF THE DRAWINGS

A better understanding of my invention as well as many further features and advantages thereof will be had by now referring to the accompanying drawings in which:

FIG. 4 is a top plan view taken in the direction of the arrows 4—4 of FIG. 2;

FIG. 5 is a cross section of the chair, taken in the direction of the arrows 5—5 of FIG. 4; and, FIG. 6 is a table setting forth preferred dimensions for the chair illustrated in FIG. 5.

DETAILED DESCRIPTION OF THE PREFERRED EMBODIMENT

Figure 1:
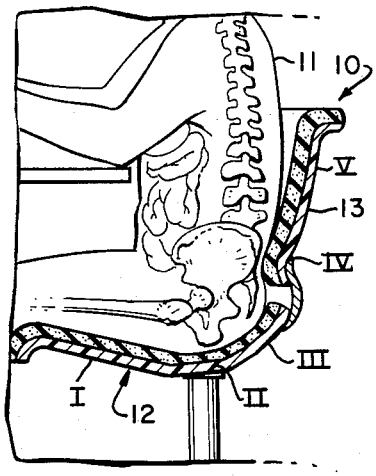
FIG. 1 is a diagramatic showing partly in cross section of parts of the human anatomy of an occupant seated in the chair of my invention, useful in explaining basic features thereof.

Referring first to FIG. 1, there is schematically illustrated a chair 10 seating an occupant 11 wherein part of the skeletal framework of the occupant is illustrated.

The chair 10 itself includes a seat 12 and back rest 13. Seat 12 is essentially provided in three sections. First, a forward section designated I, a central section designated II and a rear section designated III. The back rest 13 in turn is made up of a lower back section IV and an upper back section V.

As can be seen from the diagramatic illustration of FIG. 1, the forward section I serves as a thigh support, the central section II serves as a tuber support; that is, support for the seat bones or ischial tuberosities, and the rear section III as a sacral support; that is, for the sacrum. The lower back section IV includes a bulge functioning as a hip rest while the upper back section V can serve to provide further back support and even as a tiered arm rest when the occupant is seated in an oblique position, all as will become clearer as the description proceeds.

Figure 2:
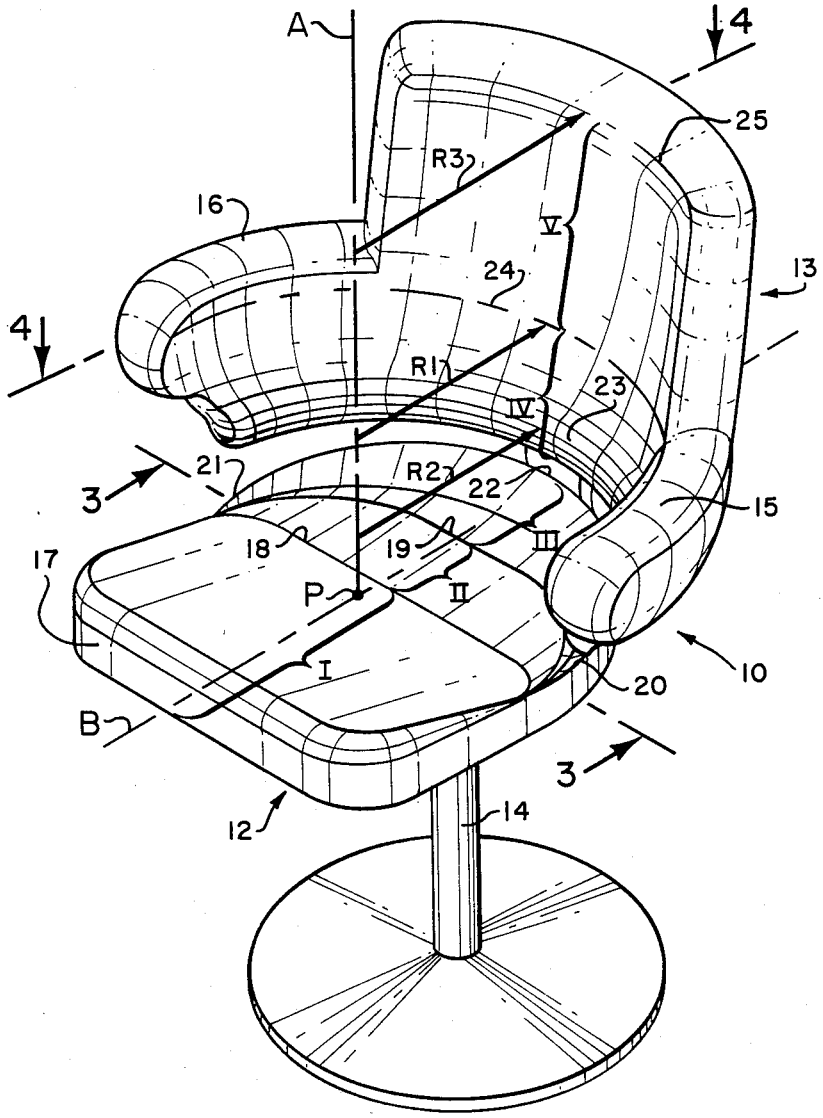
FIG. 2 is an enlarged overall ¾ front perspective view of a preferred embodiment of the chair.

Referring now to the enlarged perspective view of FIG. 2, the forward, central and rear seat sections are demarked by the brackets I, II and III respectively. Similarly, the lower and upper back sections are indicated by brackets labeled IV and V. For the particular chair illustrated in FIG. 2, the entire back 13 is separated from the seat 12 but rigidly secured to the seat 12 by an appropriate back brace as will also become clearer as the description proceeds. It should be understood, however, that the back and seat could be integrally formed if desired.

In the view of FIG. 4, there is illustrated a pedestal 14 for supporting the seat 12 at a given height above the floor. It will be understood that any appropriate stable support for the seat may be provided even of the type cantilevered from a side wall as might be employed in a waiting room. The particular pedestal itself forms no part of the present invention other than to provide for a stable base and in this respect, if the pedestal itself is not secured in a permanent position, then a large diameter platform or multiple castor elements at least five in number equally circumferentially spaced should be provided.

Also illustrated in FIG. 2 are left and right arm rests 15 and 16 constituting contoured integral extensions of the left and right sides of the back at the interception point of the lower and upper back sections IV and V.

The front edge of the forward section I is shown at 17 and falls off to define a smoothly rounded front for the seat. The interception of the forward section I with the central section II is indicated at 18 and the interception of the rear portion of the central section II with an initial portion of the rear section III is indicated at 19. It will be noted that the rear section III has a general crescent shape so that it wraps partially around the sides of the central section II as indicated at 20 and 21. As will be described in greater detail subsequently, the rear section III slopes upwardly in a rearward direction for a given distance and then increases in its upward slope to terminate in an arcuate rear edge of the seat indicated at 22. This rear edge extends for at least 150° and in the preferred embodiment 180° and essentially is shaped like a crescent-cup rim functioning as a sacral support even should the occupant sit obliquely on the seat.

Referring now to the lower section IV of the back rest, there is shown a bulge 23 functioning as the hip rest described in FIG. 1. This bulge extends over an arc of 180° being formed by inwardly and convexly curved surfaces for the side arms 15 and 16 respectively. In this respect, the interception of the lower and upper back sections is indicated by the arc 24 which is at the same level as the tops of the arm rests 15 and 16. This arc extends over 180°.

The back continues to extend upwardly and rearwardly at a slight inclination to the vertical to terminate in a top 25 which describes an arc when viewed in plan.

Still referring to FIG. 2, there is shown a point P on the seat which is midway between the front and rear edges of the seat and midway between the left and right sides of the seat. This given point is positioned forward of the interception line 18 of the forward section I and central section II. If R1 is the radius of curvature of the 180° arc for the tops of the arm rests and concavely contoured back portion along the arc 24 described in FIG. 2, and if R2 is the radius of curvature of the 180° arc of the hip rest bulge 23, then the centers of both R1 and R2 lie on a vertical axis A passing through the point P as illustrated in FIG. 2. Furthermore, if R3 is the radius of curvature of the arcuate top 25, the center of this radius also lies on the same axis A.

The radius of curvature for the rear arc 22 of the rear section III, however, has a center spaced rearwardly of the axis A so that this arc 22 underlies partially the bulge 23 when the chair is viewed in plan.

Figure 3:
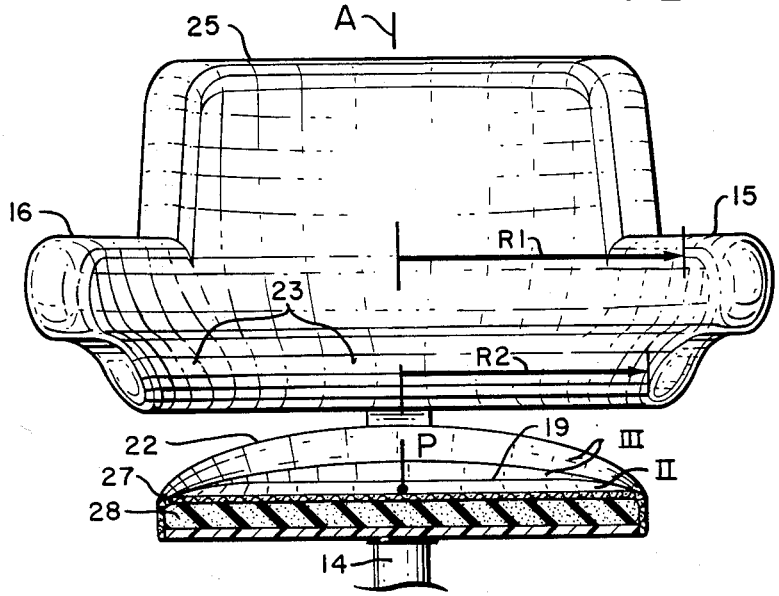
FIG. 3 is a front elevational view looking in the direction of the arrows 3—3 of FIG. 2.

Referring to FIG. 3, it will be evident that the hip rest in the form of the bulge 23 continues over the 180° arc defined by the radius R2 to the forward ends of the arm rests 15 and 16. In this respect, the inside surfaces of these arm rests slope and then form a convex curved shape to define the bulge in the same manner as the lower section of the back so that desired hip rest support is afforded for an occupant even though he sits obliquely in the chair.

With respect to the foregoing, and from the showing of FIG. 3 it can also be appreciated that the top 25 of the chair back is formed relatively flat. By this arrangement, there is provided a two-tiered arm rest arrangement for an occupant in that if the occupant sits obliquely, he can rest one or both arms on the flat top 25 of the upper section for the back.

In FIG. 3, corresponding parts have been designated by similar numerals and again the arcuate extent of the top of the arm rest and interception of the lower and upper sections of the back defined by the line 24 as well as the arcuate extent of the hip rest bulge 23 as defined respectively by the radii of curvature R1 and R2 will be evident. More particularly, these latter two arcs preferably extend over 180°. The arc swept out by the top of the back 25 defined by the radius of curvature R3, in turn, is of less extent.

In the preferred embodiment and as can be seen from FIG. 4 the arcuate extent of the top of the back defined by the arc having a radius of curvature R3 extends from 80 to 90 degrees while arcuate extents of the tops of each of the arm rests 15 and 16 extend from 20 to 45 degrees each. The extreme forward ends of the arms rests 15 and 16 extend slightly beyond the 180° arcs so that the arcuate extent for the hip rest 23 defined by the radius of curvature R2 can be at least 180° notwithstanding that the arms rests 15 and 16 are undercut at their forward portions. This latter undercutting as illustrated in FIG. 4 leaves room for an occupant's thighs when sitting obliquely.

For the particular chair chosen for illustrative purposes, R1 is from 9½ to 10½ inches, R2 is from 8 inches to 9 inches and R3 is from 10½ inches to 11½ inches.

Referring now to the side cross section of FIG. 5, final details of the seat and back construction will become evident. Thus, the forward section I is illustrated in FIG. 5 as well as the other figures as being flat from side-to-side and sloping downwardly at an angle $\alpha$ from 10 to 13 degrees from its highest point on front edge 17 to its interception 18 with the central section II. As described heretofore, the front edge falls off to define a smoothly rounded front for the seat, this forward section as also described functioning as a thigh support.

The downward sloping of the forward section is gradual from zero degrees at the highest point of the front edge to 13 degrees at the junction with the central section. This slope as noted not only prevents the sitter's body from slipping forward but it also facilitates the balancing of the pelvis. By avoiding making this angle greater than 13°, too great a backward tilting is avoided so that the body will not become wedged in the seat, thereby making it convenient to get up. Further, the rearward slope is sufficiently gentle as to avoid any straining of the ligaments at the front and back of the spine. In the upright position, this slope is so gentle that it does not tilt the pelvis backward, preserving the lumbar curve and protecting the back. The gentle slope itself together with the fact that the forward section is flat from side to side makes the occupant or sitter feel secure and yet free to move about in the chair and there is a minimum of muscular tension over prolonged periods.

As noted, the front edge 17 of the forward section falls off below the highest point of the seat to provide a smoothly rounded front. This fall off clears the area under the popliteal grooves, providing for forward inclination of the body without interfering with blood circulation.

Still referring to FIG. 5, the central section II is also flat from side to side where it joins the forward section. This central section, however, slopes upwardly at an angle of from 4°-6° from its interception with the forward section at 18 to its interception with the rear section at 19. The slightly forward tilted surface will bring the pelvis upright to where it is most comfortable and further reduces vertical stress on the spine. The tilt angle of the central section is indicated at $\beta$ in FIG. 5.

The rear section III has a general crescent shape when viewed in plan, as will be evident from both FIGS. 2 and 4 this crescent shape wrapping partially around the sides of the central section. A middle initial portion of the rear section intercepting the central section at line 19 between the wrapped around parts slopes upwardly at an angle from 10°-15° in a rearward direction for a given distance, this angle being indicated at $\gamma$ in FIG. 5. Thereafter, this angle increases in slope to an inclination of from 33°-37° over a greater distance than the referred to given distance, this latter angle being indicated at $\delta$ in FIG. 5. As described heretofore, this rear section terminates in the arcuate rear edge 22 of the seat and because of the wrap-around configuration as described heretofore, proper support is provided for the sacral area of an occupant, even when sitting obliquely on the seat.

In general, the rear section is of a crescent cup rim configuration and gives the sensation of a tiny pillow tucked behind the occupant's buttocks. The placing of the sacrum against this rear section support relieves the work of antigravity muscles, the sacrospinalis and psoas.

Summarizing, the main function of the compound curves described for the central and rear sections of the seat is to tilt the pelvis slightly forward to a balanced position in the majority of common seated postures.

Still referring to FIG. 5, there is clearly evident the convex curve configuration in the lower back section IV constituting the hip rest bulge 23. The 180° extent of this bulge in a horizontal plane has already been described. Essentially, the hip rest bulge stabilizes the body just below the top of the pelvis near the iliac crest. The frontally convex portion of the hip rest provides lumbo-sacral stability to a backward tilting pelvis, providing back stabilization, producing a normal lordosing of the lumber vertebral column and reduces the antigravity "hunting" action of the sacrospinalis and psoas muscles that occurs when the top of the sacrum is not resting against the hip rest. Because of this relief offered, the sitter unconciously seeks postures in which the scarum touches this hip rest.

The upper section of the back rest constitutes a continuation from the lower section at the intercepting line 24 and continues upwardly and rearwardly at an inclination to the vertical of from 14°-16°. This inclination is indicated by the angle $\theta$. The upper back section is concavely contoured when viewed in plan, as described heretofore over the smaller arc of 80°-90° whereas the lower back section is concavely contoured when viewed in plan over 180°, the same merging into the arm rests as described.

In the chair illustrated in FIG. 5, there is shown a horizontal baseline B which represents the average horizontal position of the seat when occupied and to which reference various measurements are made. Thus, the letters a, b and c represent the vertical distance along the axis A of the centers of the radii of curvatures R1, R2 and R3 respectively.

The baseline B can also be considered a fore and aft line, midway between the left and right sides of the chair along which measurements of the three seat sections can be taken between the front and rear edges of the seat. Thus, as illustrated in FIG. 5, the fall off portion of the front 17 of the forward section extends for a distance d while the rearwardly inclined sloping of the forward section takes place over a distance e. The dimensions d+e represent the overall length of the forward section between its front and the interception line 18. The distance along the baseline B in a fore and aft direction of the central section II is indicated at f while the initial inclination and subsequent inclination of the rear sections as measured along the fore and aft baseline B are of distances represented by g and h respectively.

Finally, the average height of the seat above the floor as determined by the pedestal 14 is indicated at i.

FIG. 6 is a table giving values for the various dimensions of FIG. 5 for a preferred chair embodiment. Some variation is possible, as will be evident from the previous description. Essentially, the distance between the front and rear of the rear section as measured along the fore and aft line B is approximately equal to 0.850 to 0.90 the distance between the front and rear of the central section along this line.

The distance between the front of the forward section and its interception point 18 with the central section as measured along this baseline B in a fore and aft direction is from $2\frac{1}{4}$ to $2\frac{3}{4}$ times the referred to distance between the front and rear of the central section.

The distances a, b and c can vary from 8–10 inches, $3\frac{1}{2}$ to $4\frac{1}{2}$ inches and 14–16 inches, respectively.

Finally, the height of the seat above the floor indicated by the dimension i may vary from 16–19 inches.

In the preferred embodiment, the chair and back rest may be molded plastic elements incorporating the described compound curves, the back rest also including the integrally formed arm rest. Both these components rigidly secured as by the brace 26 shown in FIG. 5 are upholstered on their used surfaces with a cushioned padding. Preferably, an open-weave upholstery fabric backed with reticulated foam for ventilation and softness to the touch is used. The preferred cushioning material is a two inch foam that compresses to one inch under a 170 pound load as indicated at 28 between the covering 27 and the hard plastic sheet making up the seat. Similar covering and foam are used for the back and arm rests as indicated by the cross section in FIG. 5.

My chair as described above provides essentially strategically located surfaces against which the open-chain system of links of the body can rest to obtain internal rigidification. As can be seen from the drawings, the new seating system, unlike previous chairs, is a complex of platforms shaped to offer a great variety of resting places where the sitter or occupant can temporarily fix the body by closing and locking the links.

In the upright position, the body is braced by the feet against the floor, the buttocks against the rear section in the form of the crescent cup rim, the pelvis against the hip rest, and the elbows against the arm rests. In the slouched position, the upper body is braced by the back rest and the legs stretched forward and crossed at the ankles locks the knees and pelvis and serve as a stanchion to the floor. Crossing the legs at the knee and thighs acts to rigidify the pelvis and keep it from rocking. This triangular or pyramidal pattern can be readily seen in many other of the various postures possible.

SUMMARY

Summarizing, the chair of my invention provides in essence a new seating system. It is the first to motivate changes in posture and facilitate body movement during prolonged sitting. To achieve these features, I have created a series of curves in the seat and in the hip, back and arm rests. From my studies of human kinesiology I recognize that in the sitting position the body is in a state of maximum mobility; the open links of the segments of the body would slump like a dropped chain if not supported and stabilized by the parts of a chair, or not held erect by muscular effort. From my studies of human physiology, I learned that muscles tire if they are held in a sustained contraction and that fatigue can be eliminated by reducing the strain on muscles and by periodically relaxing the contractions. The series of curves I derived give the body links support and stability in a great variety of postures, and invite easy transition from one posture to another which gives previously contracted muscles a chance to relax.

As a result of these special curves, the sitter is less fatigued after prolonged sitting and, due to the stimulating effect of the changes in position and being in motion occasionally, the sitter remains more alert and productive. I achieved this without resorting to putting moving parts into the chair.

I claim:

1. A physiological chair including a seat having forward, central and rear sections, (a) said forward section sloping downwardly at a first acute angle adjacent to its front edge to its interception with said central section to provide thigh support for an occupant;

(b) said central section sloping upwardly at an angle less than said acute angle from its interception with said forward section to its interception with said rear section to provide a tuber support for said occupant;

(c) said rear section having a generally crescent shape when viewed in plan so that it wraps partially around the sides of said central section, said rear section initially sloping upwardly at an acute angle corresponding to said first acute angle, thence gradually sloping upwardly more steeply to terminate in an arcuate edge of the seat extending over at least 150° and being in the shape of a cup rim to provide sacral support for an occupant, even should said occupant sit obliquely on said seat; and (d) back and arm rests, said back rest including a lower section concavely contoured when viewed in plan and including a convexly curved portion when viewed in side cross section providing a bulge functioning as a hip rest, each of said arm rests constituting integral continuations of said concavely contoured back portion over arcuate extents so that the tops of the arm rests and concavely contoured back at the same horizontal level define a continuous arc when viewed in plan, said arm rests having downwardly sloping inner surfaces including convex curved portions providing bulges at the same level as and integrally connecting with the bulge on said lower back portion so that the hip rest is extended over a continuous arc and hip and back support is provided by the arm rests when said occupant sits obliquely in said seat.

2. A chair according to claim 1, in which the arc defined by the tops of said arm rests and concavely contoured back extends over 180° and the arc for said hip rest similarly extends over 180°, the radii of curvature for each of said arcs lying on a common vertical axis; and wherein said forward section and the initial part of said central section for said seat are flat from side to side.

3. A physiological chair, including, in combination, a seat, a back, left and right arm rests, and a pedestal supporting the seat at a given height above the floor, said chair being characterized in that:

(a) said seat is comprised of a forward section, a central section and a rear section, (1) said forward section being flat from side to side and sloping downwardly at an acute angle of from 10°–13° from its front edge to its interception with said central section, said front edge rolling off to define a smoothly rounded front for the seat, said forward section functioning as a thigh support;

(2) said central section being flat from side to side where it joins said forward section and sloping upwardly at an angle of from 4°–6° from its interception with said forward section to its interception with said rear section, said central section functioning as a tuber support; and (3) said rear section having a generally crescent shape when viewed in plan so that it wraps partially around the sides of said central section, a middle initial portion of said rear section intercepting said central section between the wrapped around parts sloping upwardly at an angle from 10° to 15° in a rearward direction for a given distance thence increasing in slope to an inclination of from 33°–37° over a distance greater than said given distance to terminate in an arcuate rear edge of the seat extending over 180°, said rear section thereby providing the shape of a crescent-shaped cup rim and functioning as a sacral support even should an occupant sit obliquely on said seat;

(b) said back having a lower and upper section, the lower section being convexly curved when viewed in side cross section to provide a bulge functioning as a hip rest, said back thence extending upwardly and slightly rearwardly at an inclination to the vertical of from 14°–16°, both said lower and upper sections being concavely contoured when viewed in plan over an arc of from 80°–90°; and (c) each of said arm rests constituting integral continuations of said concavely contoured back at the interception of said lower and upper sections over arcuate extents of from 50 to 45 degrees each, so that the tops of said arm rests and concavely contoured back at the same horizontal level demarking the interception of the lower and upper sections of said back define an arc of 180° when viewed in plan, said arm rests having downwardly sloping inner surfaces including convexly curved portions providing bulges integrally connecting with the bulge on said lower section of the back so that the hip rest is extended over an arc of 180° and hip and back support is provided by the arm rests when an occupant sits obliquely on said seat, the top of the upper section of the back serving as an arm rest for such oblique positions so that a two-tiered arm rest arrangement is provided, whereby changes in posture of an occupant are motivated during prolonged seating, proper support and stability being provided for a variety of different postures so that an occupant remains more alert and productive than would otherwise be possible.

4. A chair according to claim 3, in which the mid point of said seat between its front and rear edges and its left and right sides constitutes a given point positioned forward of the interception of said forward section and central section and wherein if R1 is the radius of curvature of said 180° arc for the tops of the arm rests and concavely contoured back at the same level, and R2 the radius of curvature of said 180° arc of said bulge defining said hip rest, then the centers of R1 and R2 both lie on a vertical axis passing through said given point.

5. A chair according to claim 4, in which the top of said back follows an arc having a radius of curvature R3 whose center falls on said vertical axis.

6. A chair according to claim 5, in which R1 is $9\frac{1}{2}$ to $10\frac{1}{2}$ inches, R2 is 8–9 inches and R3 is $10\frac{1}{2}$ to $11\frac{1}{2}$ inches.

7. A chair according to claim 6, in which the distance between the front and rear of said rear section as measured along a fore and aft line midway of the sides of the seat is approximately equal to 0.850 to 0.90 the distance between the front and rear of said central section along said line, and wherein the distance of said forward section measured along said line is from $2\frac{1}{4}$ to $2\frac{3}{4}$ times said distance between the front and rear of said central section.

8. A chair according to claim 7, in which the levels of the centers of R1, R2 and R3 above said given point are 9 to 11 inches, 8 to 9 inches and 10 to 12 inches respectively.

9. A chair according to claim 8, in which said given height above the floor at which said seat is supported by said pedestal is from 16 to 19 inches.

* * * * *